US012768575B2

(12) United States Patent
Hong et al.

(10) Patent No.: US 12,768,575 B2
(45) Date of Patent: Oct. 20, 2026

(54) THERMOELECTRIC ELEMENT COOLING DEVICE AND REFRIGERATOR COMPRISING SAME

(71) Applicant: SAMSUNG ELECTRONICS CO., LTD., Suwon-si (KR)

(72) Inventors: Jimin Hong, Suwon-si (KR); Jungwoo Yoo, Suwon-si (KR); Insub Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 168 days.

(21) Appl. No.: 18/923,068

(22) Filed: Oct. 22, 2024

(65) Prior Publication Data

US 2025/0123032 A1 Apr. 17, 2025

Related U.S. Application Data

(63) Continuation of application No. PCT/KR2024/096297, filed on Oct. 10, 2024.

(30) Foreign Application Priority Data

Oct. 17, 2023 (KR) ..... 10-2023-0139050
Apr. 2, 2024 (KR) ..... 10-2024-0044988

(51) Int. Cl.
*F25B 21/02* (2006.01)

(52) U.S. Cl.
CPC ..... *F25B 21/02* (2013.01); *F25B 2321/0251* (2013.01)

(58) Field of Classification Search
CPC .. F25B 21/02; F25B 2321/0251; F25D 15/00; F28D 21/00; F28F 13/00; C01B 32/20
See application file for complete search history.

(56) References Cited

U.S. PATENT DOCUMENTS 9,343,784 B2 * 5/2016 Wayne ..... H01M 10/6555
9,365,001 B2 6/2016 Usui et al.
(Continued)

FOREIGN PATENT DOCUMENTS

JP 2004-20007 1/2004
JP 5603858 10/2014
(Continued)

OTHER PUBLICATIONS

International Search Report and Written Opinion of the International Searching Authority dated Feb. 6, 2025 for International Application No. PCT/KR2024/096297.

*Primary Examiner* — Filip Zec
(74) *Attorney, Agent, or Firm* — STAAS & HALSEY LLP

(57) ABSTRACT

Disclosed is a thermoelectric element cooling device including: a thermoelectric element having an endothermic surface and an exothermic surface; a first heat dissipation plate connected to the endothermic surface and configured to dissipate heat to the endothermic surface; a first heat exchanger configured to transfer heat to the first heat dissipation plate; a second heat dissipation plate configured to dissipate heat received from the exothermic surface to a second heat exchanger; the second heat exchanger configured to release heat received from the second heat dissipation plate to the outside; and a thermoconductive member disposed at at least one position between the endothermic surface of the thermoelectric element and the first heat dissipation plate or between the exothermic surface and the second heat dissipation plate, wherein the thermoconductive member has: one side in contact with one of the surfaces of the thermoelectric element; and the other side in contact with the first heat dissipation plate or the second heat dissipation plate, the thermoconductive member includes a plurality of anisotropic, thermoconductive fillers, and at
(Continued)

least one of the plurality of anisotropic, thermoconductive fillers is located adjacent to the one side and the other side.

15 Claims, 16 Drawing Sheets

(56) References Cited

U.S. PATENT DOCUMENTS

| | | | | |
|---|---|---|---|---|
| 9,560,791 | B2 | 1/2017 | Aramaki et al. | |
| 10,453,773 | B2 * | 10/2019 | Strader | F28F 21/02 |
| 10,589,998 | B2 * | 3/2020 | Rich | B32B 18/00 |
| 10,978,369 | B2 * | 4/2021 | Strader | F28F 21/02 |
| 11,667,531 | B2 * | 6/2023 | Murakami | C01B 32/205 264/29.2 |
| 11,670,566 | B2 * | 6/2023 | Murakami | C01B 32/205 257/712 |
| 11,745,463 | B2 * | 9/2023 | Seo | B32B 3/263 428/172 |
| 12,365,593 | B2 * | 7/2025 | Murashima | C01B 32/205 |
| 12,641,760 | B2 * | 5/2026 | Fu | H05K 7/20963 |
| 2010/0218512 | A1 | 9/2010 | Alahyari et al. | |
| 2011/0045300 | A1 * | 2/2011 | Tamaoki | C01B 32/205 156/60 |
| 2015/0257251 | A1 * | 9/2015 | Kagawa | B05D 1/02 252/79 |
| 2016/0168037 | A1 | 6/2016 | Chu et al. | |
| 2017/0355603 | A1 * | 12/2017 | Tachibana | C01B 32/20 |
| 2018/0362823 | A1 * | 12/2018 | Liu | B32B 15/08 |
| 2018/0371608 | A1 * | 12/2018 | Moriguchi | C23C 28/044 |
| 2019/0039908 | A1 * | 2/2019 | Tachibana | C01B 32/205 |
| 2019/0270645 | A1 * | 9/2019 | Seo | C01B 32/205 |
| 2020/0048097 | A1 * | 2/2020 | Kobayashi | C01B 32/205 |

FOREIGN PATENT DOCUMENTS

| | | |
|---|---|---|
| KR | 20-0328885 | 10/2003 |
| KR | 10-1075265 | 10/2011 |
| KR | 10-2016-0011215 | 1/2016 |
| KR | 10-1926907 | 12/2018 |
| KR | 10-2271221 | 7/2021 |
| KR | 10-2403182 | 5/2022 |

* cited by examiner

THERMOELECTRIC ELEMENT COOLING DEVICE AND REFRIGERATOR COMPRISING SAME

CROSS-REFERENCE TO RELATED APPLICATIONS

This application is a continuation application, under 35 U.S.C. § 111(a), of International Application No. PCT/KR2024/096297, filed on Oct. 10, 2024, which claims priority under 35 U.S.C. § 119 to Korean Patent Application No. 10-2023-0139050, filed on Oct. 17, 2023, and Korean Patent Application No. 10-2024-0044988, filed on Apr. 2, 2024, in the Korean Intellectual Property Office, the disclosures of which are incorporated by reference herein in their entireties.

TECHNICAL FIELD

The present disclosure relates to a thermoelectric element cooling device and a refrigerator including the thermoelectric element cooling device to cool a storage compartment.

BACKGROUND ART

A refrigerator is a home appliance including a main body having a storage compartment, and a cool air supply device configured to supply cool air to the storage compartment and used to keep items stored therein fresh.

A thermoelectric element cooling device that induces heating and cooling action by using the Peltier effect may be used as a cool air supply device of a refrigerator. A thermoelectric element has an exothermic surface formed at one side and an endothermic surface formed at the other side, and exothermic reaction may occur in the exothermic surface and endothermic reaction may occur in the endothermic surface by currents applied to the thermoelectric element.

The thermoelectric element cooling device transfers heat of a storage compartment of a refrigerator to an endothermic surface of a thermoelectric element, and releases heat generated in an exothermic surface of the thermoelectric element to the outside. In this case, thermoconductive members disposed between components require excellent thermal conductivity.

DISCLOSURE

Technical Problem

Provided is a thermoelectric element cooling device having improved thermal conductivity of a thermoconductive member.

Provided is a refrigerator including a thermoelectric element cooling device having improved thermal conductivity of a thermoconductive member.

The technical problems to be solved are not limited to the technical problems as described above, and thus other technical problems may be inferred by those of ordinary skill in the art based on the following descriptions.

Technical Solution

Aspects of embodiments of the disclosure will be set forth in part in the description which follows and, in part, will be apparent from the description, or may be learned by practice of the presented embodiments.

According to an embodiment of the disclosure, a thermoelectric element cooling device includes a thermoelectric element including an endothermic surface and an exothermic surface; a first heat dissipation plate connected to the endothermic surface and configured to dissipate heat to the endothermic surface; a first heat exchanger configured to transfer heat to the first heat dissipation plate; a second heat dissipation plate configured to dissipate heat received from the exothermic surface; a second heat exchanger configured to release heat received from the second heat dissipation plate to the outside; and a thermoconductive member disposed at at least one of: a position between the endothermic surface of the thermoelectric element and the first heat dissipation plate or a position between the exothermic surface and the second heat dissipation plate, wherein the thermoconductive member has: one side in contact with one of the surfaces of the thermoelectric element; and the other side in contact with the first heat dissipation plate or the second heat dissipation plate, the thermoconductive member includes a plurality of anisotropic, thermoconductive fillers, and at least one anisoptropic, thermoconductive filler of the plurality of anisotropic, thermoconductive fillers is located adjacent to each of the one side and the other side.

According to an embodiment of the disclosure, the plurality of anisotropic, thermoconductive fillers may include one or more carbonaceous fibers. The one or more carbonaceous fibers may be arranged in a lengthwise direction toward the one side and the other side.

According to an embodiment of the disclosure, the one or more carbonaceous fibers may have an average length of −20% to +20% of a distance between toward the one side and the other side.

According to an embodiment of the disclosure, the one or more carbonaceous fibers may be aligned at angles of −45° to +45° with respect to the lengthwise direction.

According to an embodiment of the disclosure, the one or more carbonaceous fibers may have a C content of 90% or more in an elemental analysis.

According to an embodiment of the disclosure, the one or more carbonaceous fibers may have an average thermal conductivity of 100 W/m·K or more.

According to an embodiment of the disclosure, the one or more carbonaceous fibers may include at least one of carbon fibers, graphene flakes, carbon nanotubes, or graphene nanotubes.

According to an embodiment of the disclosure, the thermoconductive member may include a ceramic filler and a binder.

According to an embodiment of the disclosure, the binder may include a silicone-based resin.

According to an embodiment of the disclosure, the thermoconductive member may have an average thickness of 50 μm to 200 μm.

According to an embodiment of the disclosure, a thermoelectric element cooling device includes a thermoelectric element including an endothermic surface and an exothermic surface; a first heat dissipation plate connected to the endothermic surface and configured to dissipate heat to the endothermic surface; a first heat exchanger configured to transfer heat to the first heat dissipation plate; a second heat dissipation plate configured to dissipate heat received from the exothermic surface to a second heat exchanger; the second heat exchanger configured to release heat received from the second heat dissipation plate to the outside; and a thermoconductive member disposed at at least one of: a position between the endothermic surface of the thermoelectric element and the first heat dissipation plate, or a position between the exothermic surface and the second heat dissipation plate, wherein the thermoconductive member includes: a plurality of carbonaceous fibers including a C content of 90% or more, and a silicone-based binder, carbonaceous fibers of the plurality of carbonaceous fibers are aligned at angles of −45° to +45° with respect to a heat conduction direction, and the thermoconductive member has an average thermal conductivity of 15 W/m·K or more.

According to an embodiment of the disclosure, the carbonaceous fibers of the plurality of carbonaceous fibers may have an average length of 50 μm to 400 μm.

According to an embodiment of the disclosure, the carbonaceous fibers of the plurality of carbonaceous fibers may have a C content of 90% or more in an elemental analysis.

According to an embodiment of the disclosure, the carbonaceous fibers of the plurality of carbonaceous fibers may have an average thermal conductivity of 100 W/m·K or more.

According to an embodiment of the disclosure, the carbonaceous fibers of the plurality of carbonaceous fibers may include at least one of carbon fibers, graphene flakes, carbon nanotubes, or graphene nanotubes.

In accordance with another aspect of the present disclosure, a refrigerator includes: a main body; a storage compartment formed in the main body; and a thermoelectric element cooling device configured to cool the storage compartment, wherein the thermoelectric element cooling device includes: a first heat exchanger located in the storage compartment and configured to transfer heat from the storage compartment to a first heat dissipation plate; a first heat dissipation plate connected to the first heat exchanger and configured to transfer heat to an endothermic surface; a thermoelectric element having the endothermic surface on one surface and an exothermic surface on the other surface; a second heat dissipation plate configured to dissipate heat received from the exothermic surface to a second heat exchanger; the second heat exchanger configured to release heat received from the second heat dissipation plate out of the main body; and a thermoconductive member disposed at at least one position between the endothermic surface of the thermoelectric element and the first heat dissipation plate or between the exothermic surface and the second heat dissipation plate, wherein the thermoconductive member has: one side in contact with one of the surfaces of the thermoelectric element; and the other side in contact with the first heat dissipation plate or the second heat dissipation plate, the thermoconductive member includes a plurality of anisotropic, thermoconductive fillers, and at least one of the plurality of anisotropic, thermoconductive fillers is located adjacent to the one side and the other side.

In accordance with another aspect of the present disclosure, a refrigerator includes: a main body; a storage compartment formed in the main body; and a thermoelectric element cooling device configured to cool the storage compartment, wherein the thermoelectric element cooling device includes: a first heat exchanger located in the storage compartment and configured to transfer heat from the storage compartment to a first heat dissipation plate; the first heat dissipation plate connected to the first heat exchanger and configured to transfer heat to an endothermic surface; a thermoelectric element having the endothermic surface on one surface and an exothermic surface on the other surface; a second heat dissipation plate configured to dissipate heat received from the exothermic surface to a second heat exchanger; the second heat exchanger configured to release heat received from the second heat dissipation plate out of the main body; and a thermoconductive member disposed at at least one position between the endothermic surface of the thermoelectric element and the first heat dissipation plate or between the exothermic surface and the second heat dissipation plate, wherein the thermoconductive member includes carbonaceous fibers having a C content of 90% or more and a silicone-based binder, the carbonaceous fibers are aligned at angles of −45° to +45° with respect to a heat conduction direction, and the thermoconductive member has an average thermal conductivity of 15 W/m·K or more.

Advantageous Effects

According to an embodiment of the present disclosure, heat transfer efficiency of a thermoelectric element cooling device may be increased.

According to an embodiment of the present disclosure, effective heat exchange of a thermoelectric element cooling device may be obtained.

According to an embodiment of the present disclosure, energy consumption of a refrigerator may be reduced by increasing cooling efficiency of a thermoelectric element cooling device.

However, the effects obtainable according to the embodiments of the present disclosure are not limited to those described above, and any other effects not mentioned herein will be clearly understood from the following descriptions by those skilled in the art to which the present disclosure pertains.

DESCRIPTION OF DRAWINGS

These and/or other aspect of the disclosure will become apparent and more readily appreciated from the following description of embodiments, taken in conjunction with the accompanying drawings listed below.

MODES OF THE INVENTION

Figure 1:
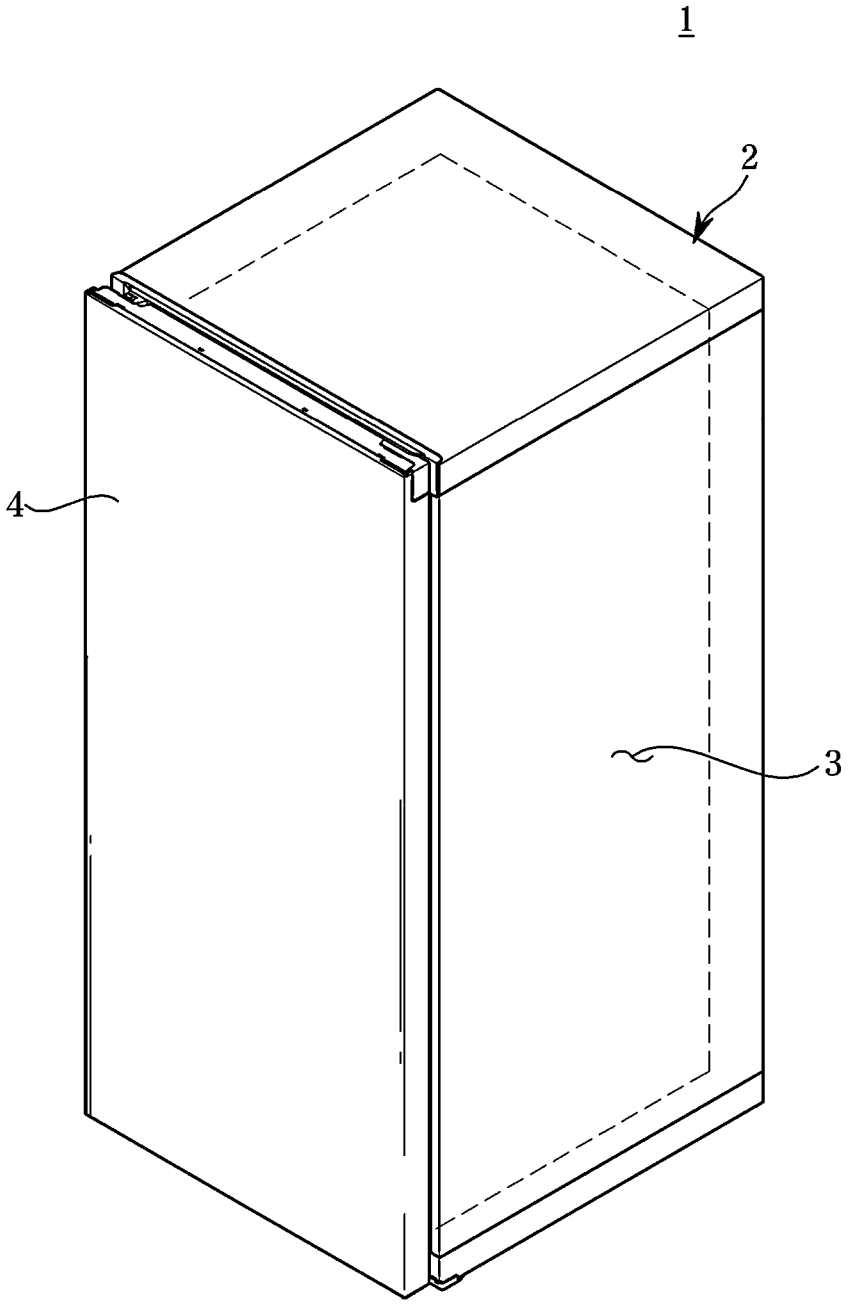
FIG. 1 is a view illustrating a refrigerator according to an embodiment of the present disclosure.

Various embodiments of the present disclosure and terms used herein are not intended to limit the technical features described in the present disclosure to particular embodiments and should be understood to include various changes, equivalents, or substitutes of the embodiments.

In relation to descriptions of the drawings, like reference numerals refer to like or related elements throughout.

Singular forms of nouns corresponding to items are intended to include one or multiple items as well, unless the context clearly indicates otherwise.

Throughout the present disclosure, expressions such as "A or B", "at least one of A and B", "at least one of A or B", "A, B, or C", "at least one of A, B, and C", and "at least one of A, B, or C" may include only one of the listed elements of each expression or any combination thereof. For example, the expression "at least one of A or B" may include, A, B, or A and B. The expression "at least one of A, B, or C" may include A, B, C, A and B, A and C, B and C, or A and B and C. The expression "at least one of A, B, C, or D" may include A, B, C, D, A and B, A and C, A and D, A and B and C, A and B and D, A and C and D, B and C, B and D, B and C and D, C and D, or A and B and C and D, and so on.

The term "and/or" includes any and all combinations of a plurality of associated listed items.

The terms "first", "second", etc., are used to distinguish different components from each other and are not used to limit the components in other aspects (e.g., importance or order).

Also, the terms such as 'front surface', 'rear surface', 'upper surface', 'lower surface', 'side surface', 'left', 'right', 'upper', and 'lower' are defined based on the drawings and the shape and position of each element are not limited by these terms.

The terms "unit", "module", and "member" may be implemented using a hardware or software component. According to embodiments, a plurality of "units", "modules", and "members" may be implemented using one element or one "unit", "module", and "member" may include a plurality of elements.

The terms such as "include" and "have" are intended to indicate the existence of features, numbers, operations, components, parts, or combinations thereof disclosed in the specification, and are not intended to preclude the possibility that one or more other features, numbers, operations, components, parts, or combinations thereof may exist or may be added.

When an element is referred to as being "connected to", "coupled to", "supported by", or "in contact with" another element, it may be not only directly connected to, coupled to, supported by, or in contact with the other element but also indirectly connected to, coupled to, supported by, or in contact with the other element with a third intervening element.

It will be understood that when one element, is referred to as being "on" another element, it can be directly on the other element, or intervening elements may also be present therebetween.

Hereinafter, a thermoelectric element cooling device and a refrigerator including the same according to the present disclosure will be described in detail with reference to the drawings.

FIG. 1 is a view illustrating a refrigerator according to an embodiment of the present disclosure.

The refrigerator 1 according to the present disclosure may include a main body 2 including a plurality of adiabatic walls, a storage compartment 3 formed inside the main body 2, and a door 4 provided to open and close the storage compartment 3.

The refrigerator 1 according to the present disclosure may include at least one door 4 configured to open and close an open side of the storage compartment. One or more doors 4 may be provided to open and close one or more storage compartments, respectively, or one door 4 may be provided to open and close a plurality of storage compartments. The door 4 may be pivotally or slidably coupled to the front surface of the main body.

The door 4 may be configured to seal the storage compartment when the door 4 is closed. The door 4, like the main body 2, may include an insulation material to insulate the storage compartment when the door 4 is closed. The door 4 may include a door outer panel constituting the front surface of the door 4, a door inner panel constituting the rear surface of the door 4 and facing a storage compartment, an upper cap and a lower cap, and a door insulation material provided therein.

A gasket may be provided along boundaries of the door inner panel to be in close contact with the front surface of the main body 2 to seal the storage compartment 3 when the door 4 is closed. The door inner panel may include a dyke protruding backward such that a door basket that stores items is mounted thereon.

In addition, the door 4 may include a door body and a front panel detachably coupled to the front of the door body and constituting the front surface of the door 4. The door body may include a door outer panel constituting the front surface of the door body, a door inner panel constituting the rear surface of the door body and facing the storage compartment 3, an upper cap and a lower cap, and a door insulation material provided therein.

Door types may vary according to arrangement of storage compartments, and for example, a French door type, a side-by-side type, a bottom mounted freezer (BMF) type, a top mounted freezer (TMF) type, a 1-door refrigerator, or the like may be applied thereto.

Figure 2:
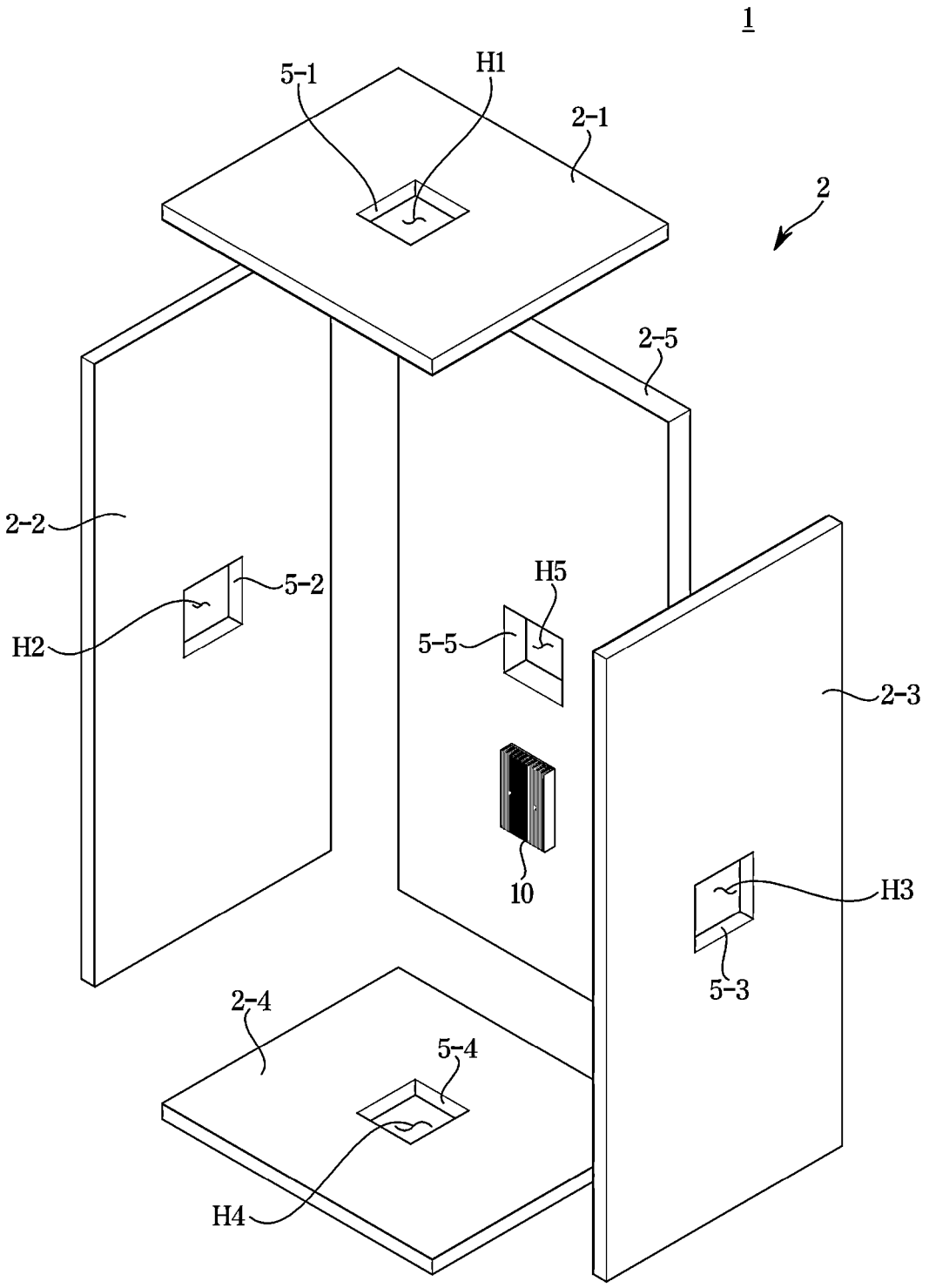
FIG. 2 is an exploded view illustrating a plurality of adiabatic walls of a refrigerator according to an embodiment of the present disclosure.

FIG. 2 is an exploded view illustrating a plurality of adiabatic walls of a refrigerator according to an embodiment of the present disclosure.

Referring to FIGS. 1 and 2, the refrigerator 1 may include the main body 2 including a plurality of adiabatic walls 2-1, 2-2, 2-3, 2-4, and 2-5, the storage compartment 3 formed inside the main body 2, the door 4 provided to open and close the storage compartment 3, and at least one thermoelectric element cooling device 10 provided to cool the storage compartment 3.

The plurality of adiabatic walls 2-1, 2-2, 2-3, 2-4, and 2-5 may be assembled to form the main body 2. The plurality of adiabatic walls 2-1, 2-2, 2-3, 2-4, and 2-5 may be coupled to each other by various known methods. For example, each of the plurality of adiabatic walls 2-1, 2-2, 2-3, 2-4, and 2-5 may include an uneven structure or a hook structure that may be inserted into each other.

The plurality of adiabatic walls 2-1, 2-2, 2-3, 2-4, and 2-5 may include an upper adiabatic wall 2-1, a left adiabatic wall 2-2, a right adiabatic wall 2-3, a lower adiabatic wall 2-4, and a rear adiabatic wall 2-5. The upper adiabatic wall 2-1, the left adiabatic wall 2-2, the right adiabatic wall 2-3, the lower adiabatic wall 2-4, and the rear adiabatic wall 2-5 may be independently provided and assembled. However, at least some of the upper adiabatic wall 2-1, the left adiabatic wall 2-2, the right adiabatic wall 2-3, the lower adiabatic wall 2-4, and the rear adiabatic wall 2-5 may be integrated with each other.

Each of the plurality of adiabatic walls 2-1, 2-2, 2-3, 2-4, and 2-5 may include a through-hole H connecting the storage compartment 3 formed in the main body 2 with the outside of the main body 2 and a through-hole wall 5 provided along the circumference of the through-hole H.

For example, the upper adiabatic wall 2-1 may include an upper through-hole H1 connecting the upper side of the storage compartment 3 formed in the main body 2 with the outside above the main body 2, and an upper through-hole wall 5-1 provided along the circumference of the upper through-hole H1. The left adiabatic wall 2-2 may include a left through-hole H2 connecting the left side of the storage compartment 3 formed in the main body 2 with the outside on the left side of the main body 2, and a left through-hole wall 5-2 provided along the circumference of the left through-hole H2. The right adiabatic wall 2-3 may include a right through-hole H3 connecting the right side of the storage compartment 3 formed in the main body 2 with the outside on the right side of the main body 2, and a right through-hole wall 5-3 provided along the circumference of the right through-hole H3. The lower adiabatic wall 2-4 may include a lower through-hole H4 connecting the lower side of the storage compartment 3 formed in the main body 2 with the outside below the main body 2, and a lower through-hole wall 5-4 provided along the circumference of the lower through-hole H4. The rear adiabatic wall 2-5 may include a rear through-hole H5 connecting the rear side of the storage compartment 3 formed in the main body 2 with the outside behind the main body 2, and a rear through-hole wall 5-5 provided along the circumference of the rear through-hole H5.

Although the through-holes H and the through-hole walls 5 are formed in all adiabatic walls in FIG. 2, the through-hole H and the through-hole walls 5 may be formed in only some adiabatic walls among the plurality of adiabatic walls. For example, if the thermoelectric element cooling device is provided in the rear through-hole wall, the through-hole and the through-hole wall may not be formed in the other through-hole walls.

The at least one thermoelectric element cooling device 10 may be located at one of the plurality of adiabatic walls 2-1, 2-2, 2-3, 2-4, and 2-5. Although one thermoelectric element cooling device 10 is shown in FIG. 2, the present disclosure is not limited thereto, and the refrigerator may also include a plurality of thermoelectric element cooling devices. In addition, if the refrigerator includes a plurality of thermoelectric element cooling devices, the plurality of thermoelectric element cooling devices may be provided at one or more walls of the plurality of adiabatic walls. For example, the thermoelectric element cooling device may be provided at each of the upper adiabatic wall and the rear adiabatic wall among the plurality of adiabatic walls. The thermoelectric element cooling device 10 may connect the storage compartment 3 with the outside of the refrigerator via the through-hole H.

The storage compartment 3 may store items. The storage compartment 3 may have an open front allowing items to be introduced into or withdrawn from the storage compartment 3. The storage compartment may be called as various names such as "refrigeration compartment", "freezer compartment", and "multi room" as well as "vegetable compartment", "fresh compartment", "cooling compartment", and "ice-making compartment". The terms such as refrigeration compartment", "freezer compartment", and "multi room" used hereinafter should be understood to encompass storage compartments with uses and temperature ranges corresponding thereto.

The at least one thermoelectric element cooling device 10 may cool the storage compartment 3 by using the Peltier effect. The Peltier effect refers to an effect of transferring heat from one side to the other side as electrons or holes move in an object with electrical properties when an electric energy is applied to the object with electrical properties (e.g., conductor and semiconductor). A thermoelectric element is an element using the Peltier effect and includes an exothermic surface to supply heat and an endothermic surface to receive heat. Thermal energy conversion efficiency of a thermoelectric element that converts electric energy into thermal energy is evaluated by the dimensionless figure of merit (ZT), and the dimensionless figure of merit (ZT) is determined by properties (e.g., electrical conductivity and thermal conductivity) of the thermoelectric element. Hereinafter, a thermoelectric element cooling device including the thermoelectric element will be described in detail.

Figure 3:
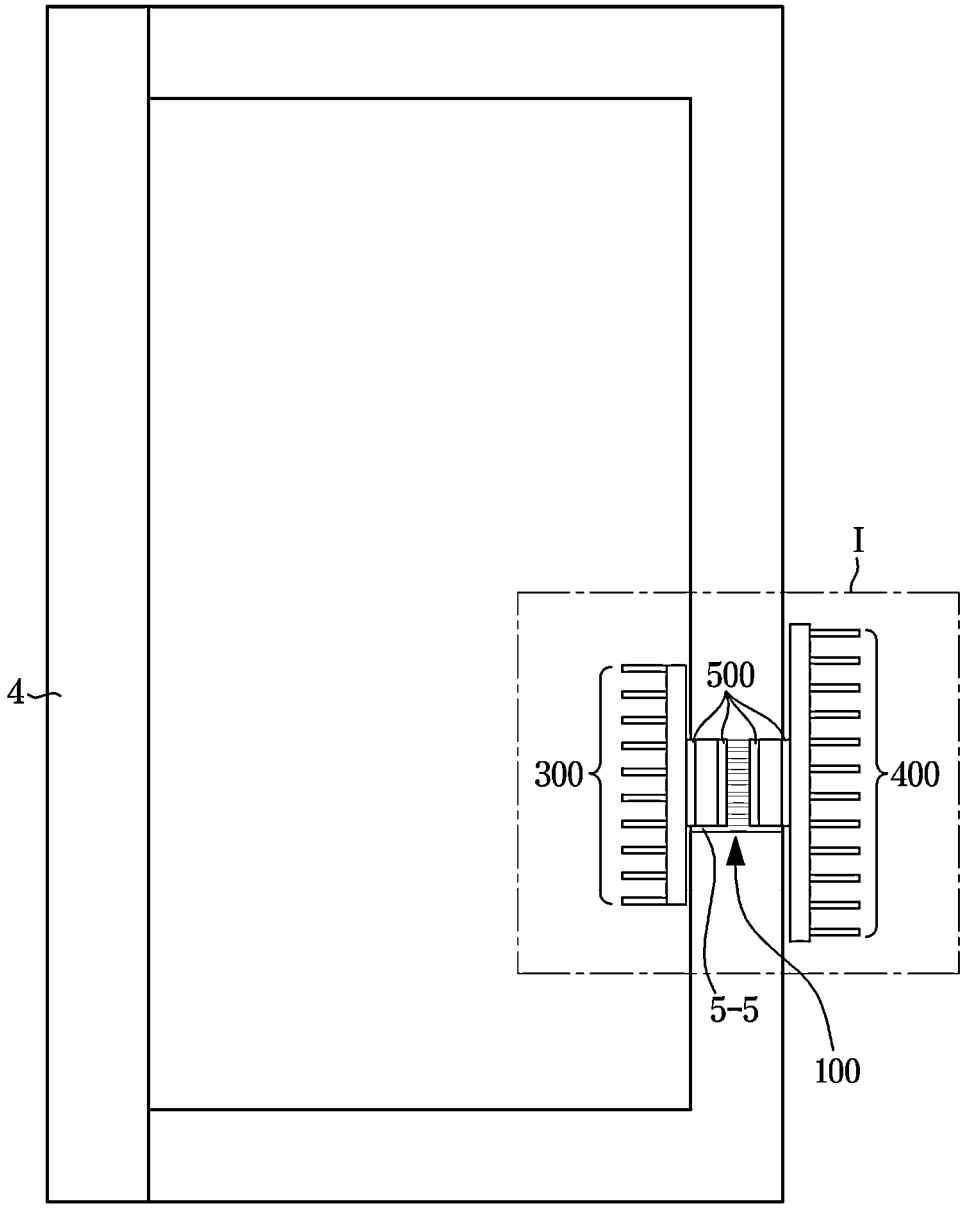
FIG. 3 is a view illustrating a thermoelectric element cooling device according to an embodiment of the present disclosure.

FIG. 3 is a view illustrating the thermoelectric element cooling device according to an embodiment of the present disclosure.

Referring to FIG. 3, the thermoelectric element cooling device 10 may be coupled to the rear through-hole wall 5-5 of the refrigerator to exchange heat of the storage compartment 3 of the refrigerator with that of the thermoelectric element cooling device 10. Because heat generated in the thermoelectric element cooling device 10 is released out of the refrigerator, cool air of the storage compartment 3 may be maintained.

Figure 4:
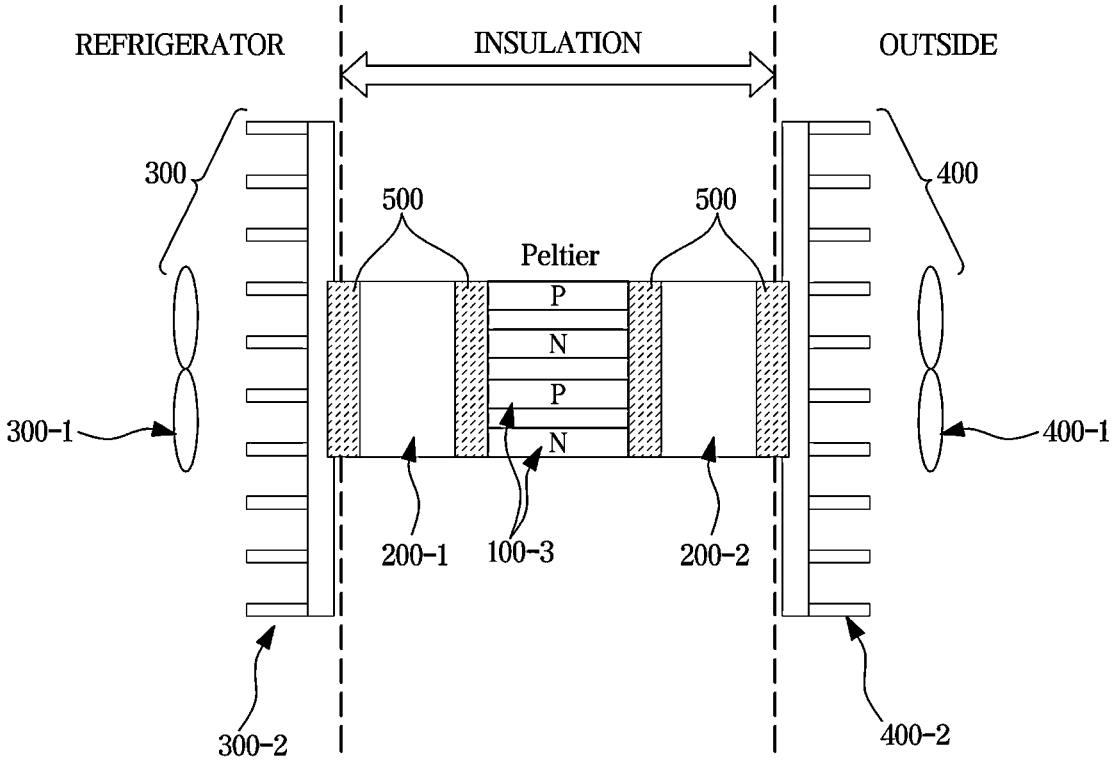
FIG. 4 is an exploded view of I of FIG. 3.

FIG. 4 is an enlarged view of I of FIG. 3.

Referring to FIG. 4, the thermoelectric element 100 may include an endothermic surface, an exothermic surface, a plurality of semiconductors 100-3, and a plurality of electrodes. The exothermic surface may be arranged to face the endothermic surface.

The endothermic surface 100-1 may absorb heat from the outside of the thermoelectric element 100. For example, if an electric energy is applied to the thermoelectric element 100, the endothermic surface 100-1 transfers thermal energy in a direction toward the exothermic surface 100-2 to lose thermal energy and absorbs heat from the outside of the thermoelectric element 100 to compensate for the lost thermal energy. The endothermic surface 100-1 may be formed of aluminum (Al), an Al alloy, copper (Cu), a Cu alloy, an Al—Cu alloy, or the like.

The exothermic surface 100-2 may release heat out of the thermoelectric element 100. For example, if electric energy is applied to the thermoelectric element 100, the exothermic surface 100-2 may receive thermal energy from the endothermic surface 100-1 and release the received thermal energy out of the thermoelectric element 100. The exothermic surface 100-2 may be formed of aluminum (Al), an Al alloy, copper (Cu), a Cu alloy, an Al—Cu alloy, or the like. Materials used to form the endothermic surface 100-1 and the exothermic surface 100-2 may be the same or different, and may include materials with high thermal conductivity.

The thermoelectric element 100 may include a semiconductor 100-3. For example, the thermoelectric element 100 may include a plurality of P-type semiconductors or a composite semiconductor device in which P-type semiconductors and N-type semiconductors are alternately disposed.

The plurality of semiconductors 100-3 may be arranged between the endothermic surface 100-1 and the exothermic surface 100-2 and may include $Bi_2Te_{2.79}Se_{0.21}$, $In_4Se_3$, filled SKD, LAST, $Mg_2Ge_{0.75}Sn_{0.25}$, $Mg_2Si_{0.3}Sn_{0.7}$, PbTe, PbSe, $Ba_8Ga_{16}Ge_{30}$, (Hf,Zr)NiSn, $La_2Te_4$, SiGe, and the like.

One electrode may be arranged between the endothermic surface 100-1 and the plurality of semiconductors 100-3. For example, one side of the electrode may be in contact with the endothermic surface 100-1, and the other side may be in contact with the plurality of semiconductors 100-3. In addition, another electrode may be arranged between the exothermic surface 100-2 and the semiconductor 100-3. For example, one side of the electrode may be in contact with the exothermic surface 100-2, and the other side may be in contact with the plurality of semiconductors 100-3. Another electrode may connect the electrode in contact with the endothermic surface 100-1 with the electrode in contact with the exothermic surface 100-2.

The plurality of electrodes may include a conductor such as aluminum, nickel, gold, and titanium, and materials of the electrodes may be the same or different.

The plurality of electrodes may be electrically connected to each other, and if currents flow through the semiconductor 100-3, thermal energy may move from the endothermic surface 100-1 to the exothermic surface 100-2.

The thermoelectric element cooling device 10 according to the present disclosure includes a first heat exchanger 300 configured to transfer heat from the storage compartment 3 formed in the main body 2 to the endothermic surface 100-1 of the thermoelectric element 100. The first heat exchanger 300 may include a plurality of heat exchange fins 300-2 for efficient heat exchange, a heat exchange base, and a fan device 300-1 allowing air to flow, and the fan device 300-1 may be a centrifugal fan that draws in air in an axial direction and discharge the air in a radial direction, and the centrifugal fan may include a blower fan. The heat exchange fins 300-2 may be formed of a metallic material with excellent average thermal conductivity, for example, Al or Cu, but is not limited thereto, and the plurality of heat exchange fins 300-2 may be integrated with the heat exchange base.

The thermoelectric element cooling device 10 according to the present disclosure may include a first heat dissipation plate 200-1 connected to the endothermic surface 100-1 for efficient heat exchange between the endothermic surface 100-1 of the thermoelectric element and the first heat exchanger 300. The first heat dissipation plate 200-1 may cool the storage compartment 3 by absorbing heat from the storage compartment 3 and transferring the heat to the endothermic surface 100-1 of the thermoelectric element 100. The first heat dissipation plate 200-1 may also be referred to as cold sink, cooling sink, cooling heat sink, cold heat sink, cooling heat sink, or the like.

The first heat dissipation plate 200-1 may be formed of a metallic material with excellent average thermal conductivity, for example, Al or Cu.

The thermoelectric element cooling device 10 according to the present disclosure may include a second heat exchanger 400 located outside the main body 2 and configured to transfer heat generated in the endothermic surface 100-1 of the thermoelectric element 100 to the outside. The second heat exchanger 400 may include a plurality of heat exchange fins 400-2 for efficient heat exchange, a heat exchange base, and a fan device 400-1 allowing air to flow, and the fan device 400-1 may be a centrifugal fan that draws in air in an axial direction and discharge the air in a radial direction, and the centrifugal fan may include a blower fan. The heat exchange fins 400-2 may be formed of a metallic material with excellent average thermal conductivity, for example, Al or Cu, but is not limited thereto, and the plurality of heat exchange fins 400-2 may be integrated with the heat exchange base.

The thermoelectric element cooling device 10 according to the present disclosure may include a second heat dissipation plate 200-2 connected to the exothermic surface 100-2 for efficient heat exchange between the exothermic surface 100-2 of the thermoelectric element and the second heat exchanger 400. The second heat dissipation plate 200-2 may absorb heat generated in the 100-main body 2 by being in contact with the exothermic surface 100-2 of the thermoelectric element 100 and release heat out of the main body 2. The second heat dissipation plate 200-2 may also be referred to as hot sink, heat dissipation heat sink, hot heat sink, or the like. The second heat dissipation plate 200-2 may be formed of a metallic material with excellent average thermal conductivity, for example, Al or Cu, but is not limited thereto.

The thermoelectric element cooling device 10 according to the present disclosure may include a thermoconductive member 500 provided at at least one position between the endothermic surface 100-1 of the thermoelectric element 100 and the first heat dissipation plate 200-1 or between the exothermic surface 100-2 and the second heat dissipation plate 200-2.

The thermoconductive member 500 according to the present disclosure has one side in contact with one surface 100-1 or 100-2 of the thermoelectric element 100; and the other side in contact with the first heat dissipation plate 200-1 or the second heat dissipation plate 200-2, and the thermoconductive member 500 includes a plurality of anisotropic, thermoconductive fillers 2000 and 3000, wherein at least one of the plurality of anisotropic, thermoconductive fillers 2000 and 3000 may be located adjacent to the one side and the other side. The thermoconductive member 500 plays a role in fixing respective components of the thermoelectric element cooling device 10 and is required to have properties as a heat transfer material that efficiently transfer heat. Accordingly, the thermoconductive member 500 may have adhesive force by including a binder and high thermal conductivity by including the plurality of anisotropic, thermoconductive fillers 2000 and 3000, so that heat conduction paths are uniformly arranged without being disconnected.

Figure 5:
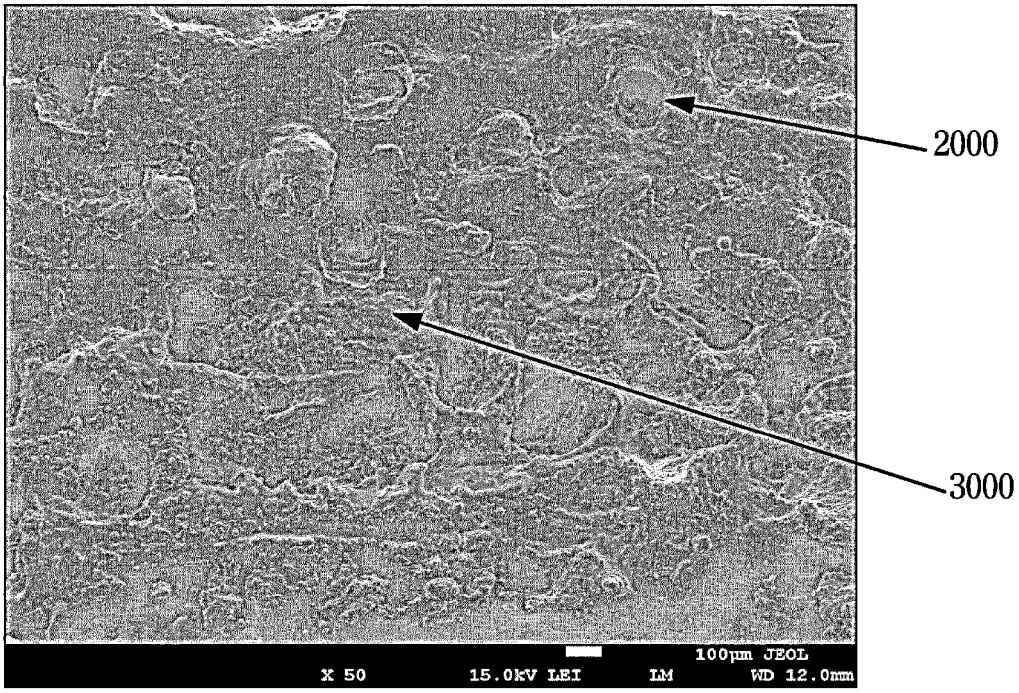
FIG. 5 is a scanning electron microscope (SEM) image of a surface of a thermoconductive member according to a comparative example cut in a direction parallel to a heat transfer direction.

FIG. 5 is a scanning electron microscope (SEM) image of a surface of a thermoconductive member according to a comparative example cut in a direction parallel to a heat transfer direction with a magnification of 50×. Referring to FIG. 5, the thermoconductive member of the comparative example has a structure in which spherical ceramic fillers 2000 are mixed in a binder 1000 (silicone), and has inferior heat conduction effect due to resistance occurring between the spherical ceramic fillers 2000.

Figure 6:
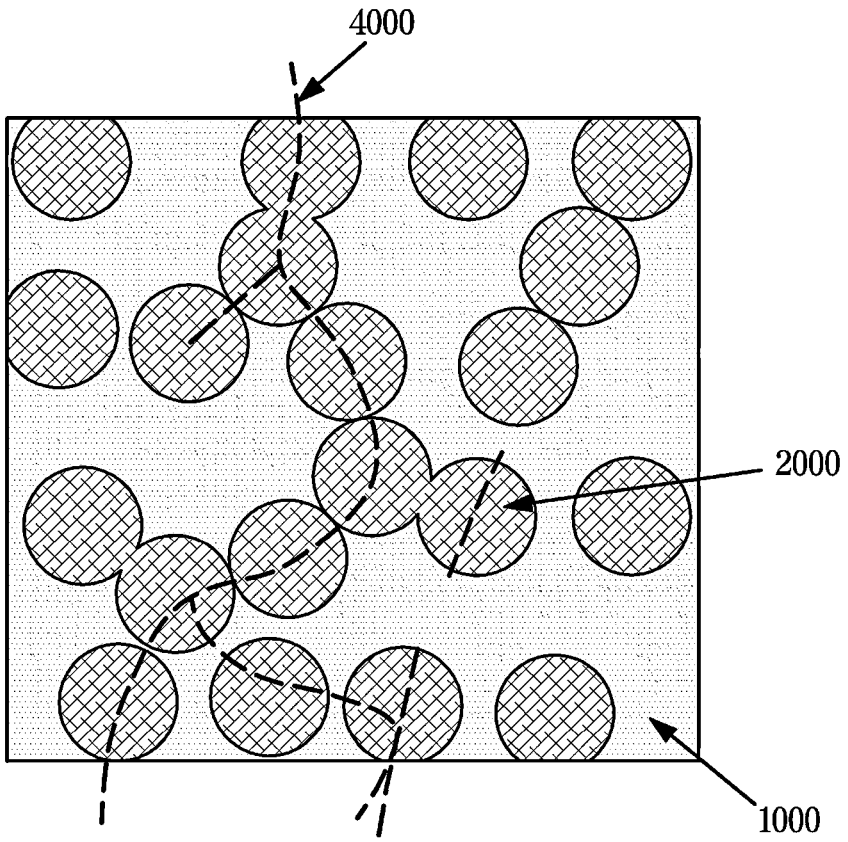
FIG. 6 is a schematic diagram illustrating a heat conduction path in a surface of a thermoconductive member according to a comparative example cut in a direction parallel to a heat transfer direction.

FIG. 6 is a schematic diagram illustrating a heat conduction path in a surface of a thermoconductive member according to a comparative example cut in a direction parallel to a heat transfer direction.

In general, a binder (silicone material) has a thermal conductivity of about 0.2 W/m·K, and a filler (ceramic material) has a thermal conductivity of about 25 W/m·K. Due to such a difference in thermal conductivity, most heat cannot pass through the binder (silicone material) but passes through the filler (ceramic material).

Meanwhile, the binder (silicone material) and the filler (ceramic material) are mixed during a manufacturing process without artificial arrangement, and thus particles of the filler (ceramic material) may be randomly and irregularly arranged and a heat conduction path may be short or very long.

In a long heat conduction path, thermal conductivity deteriorates. In the case where the heat conduction path is disconnected, heat transfer takes a detour to make the heat conduction pass longer, resulting in deterioration of thermal conductivity of the thermoconductive member. In addition, because heat conduction is proportional to size of a contact area between media, continuous occurrence of areas where the contact area becomes smaller results in deterioration of thermal conductivity of the thermoconductive member.

Referring to FIG. 6, in the thermoconductive member of the comparative example, the heat conduction path 4000 may make a detour, and thus the heat conduction path becomes longer or disconnected. Due to structural characteristics of spherical ceramic fillers 2000, contact areas between particles may locally decrease, resulting in deterioration of the heat conduction effect.

Figure 7:
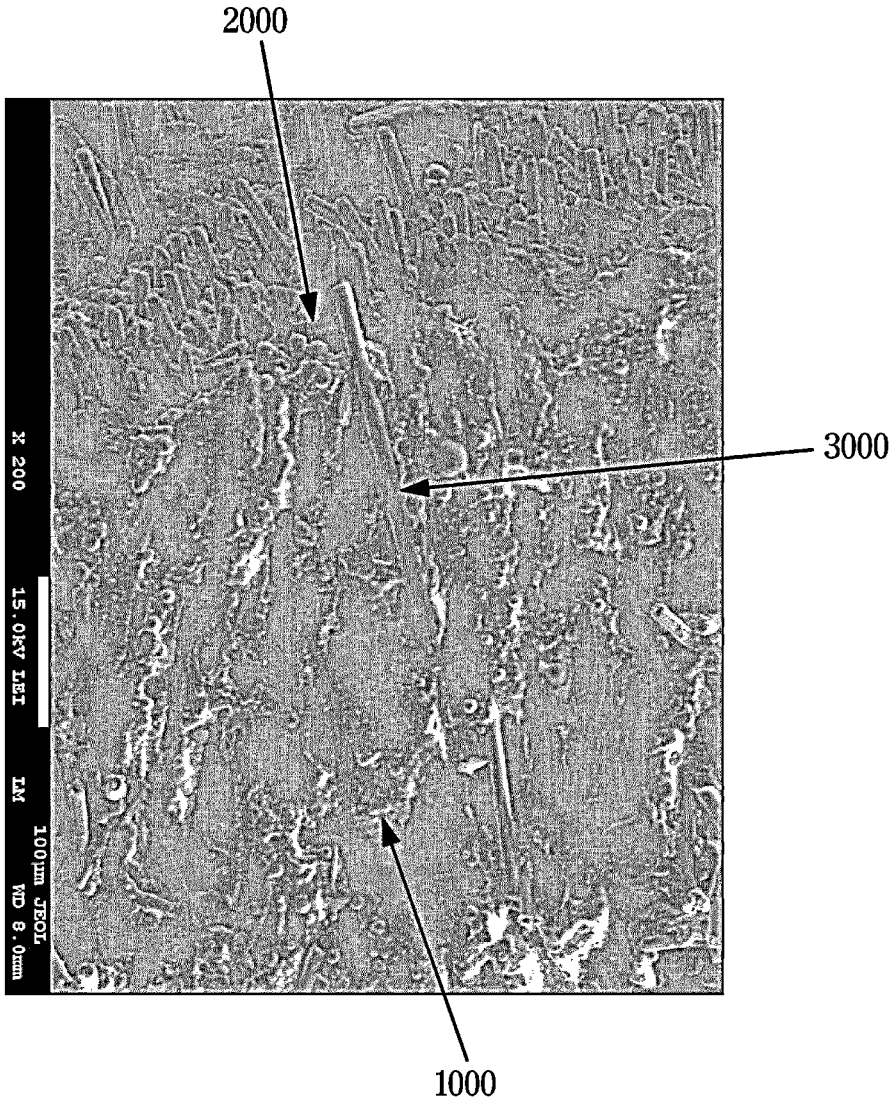
FIG. 7 is an SEM image of a surface of a thermoconductive member according to an embodiment of the present disclosure cut in a direction parallel to a heat transfer direction.

FIG. 7 is an SEM image of a surface of a thermoconductive member according to an embodiment of the present disclosure cut in a direction parallel to a heat transfer direction with a magnification of 200×. Referring to FIG. 7, the thermoconductive member of the embodiment has a structure in which spherical ceramic fillers 2000 and acicular carbonaceous fibers 3000 are mixed in a binder 1000.

Figure 8:
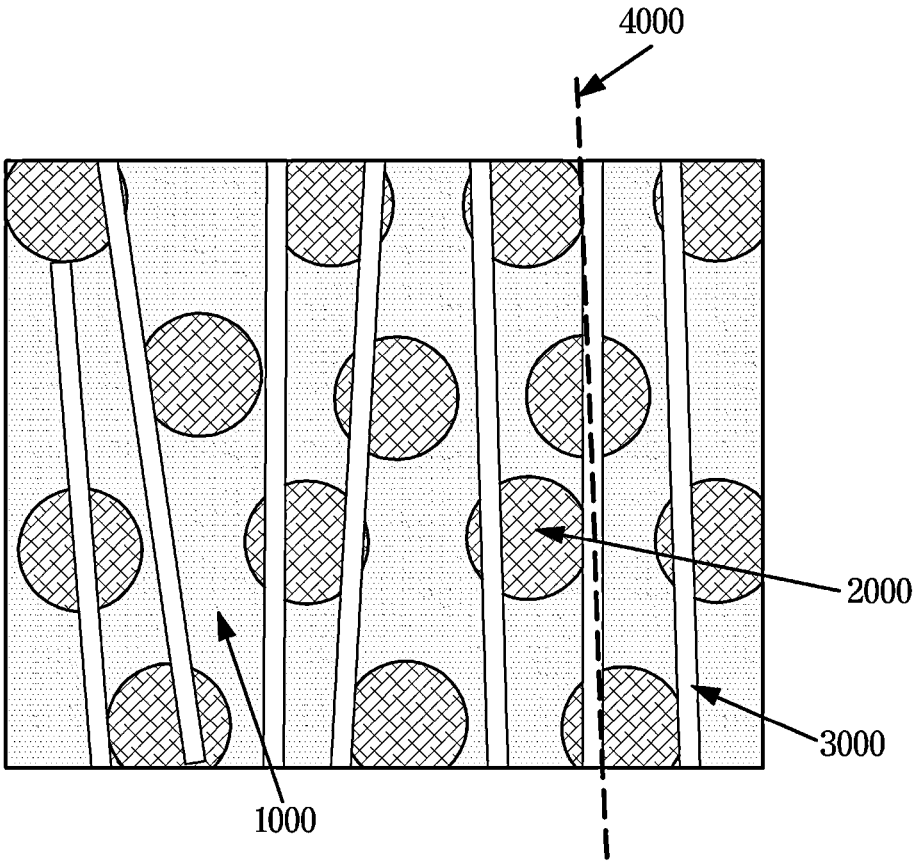
FIG. 8 is a schematic diagram illustrating a heat conduction path in a surface of a thermoconductive member according to an embodiment of the present disclosure cut in a direction parallel to a heat transfer direction.

FIG. 8 is a schematic diagram illustrating a heat conduction path in a surface of a thermoconductive member according to an embodiment of the present disclosure cut in a direction parallel to a heat transfer direction. As described above, the binder (silicone material) may have a thermal conductivity of about 0.2 W/m·K, a ceramic filler has a thermal conductivity of about 25 W/m·K, and a carbonaceous fiber filler has a thermal conductivity of about 100 W/m·K. Most of the heat cannot pass through the binder (silicone material) but passes through mixed fillers of the ceramic and carbonaceous fibers. In this case, particles of acicular carbonaceous fibers 3000 connect particles of the spherical ceramic fillers 2000 randomly arranged such that the heat conduction path becomes shorter to improve overall thermal conductivity to generally increase the thermoconductive member 500 to 15 W/m·K or more.

In addition, because the carbonaceous fibers 3000 having acicular shapes are connected to the spherical particles of the ceramic filler 2000 in contact therewith, relatively constant contact areas are formed in the heat conduction path. Thus, a heat conduction bottleneck phenomenon, which occurs when the contact area between media locally decreases, does not occur, and thus high-performance thermal conductivity may be achieved.

A thermoconductive member according to another embodiment of the present disclosure may have a structure in which spherical ceramic fillers 2000 and chopped acicular carbonaceous fibers 3000 are mixed in a binder 1000.

Figure 9:
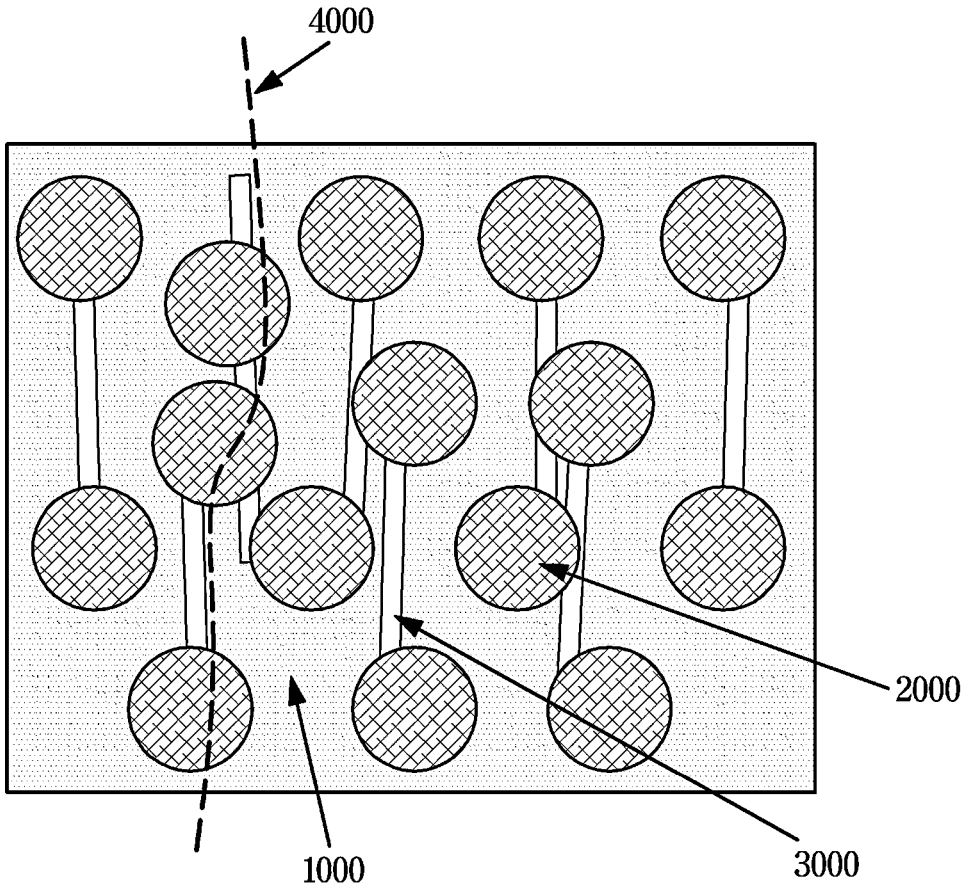
FIG. 9 is a schematic diagram illustrating a heat conduction path in a surface of a thermoconductive member according to an embodiment the present disclosure cut in a direction parallel to a heat transfer direction in the case where the thermoconductive member includes chopped carbonaceous fibers.

FIG. 9 is a schematic diagram illustrating a heat conduction path in a surface of a thermoconductive member according to an embodiment the present disclosure cut in a direction parallel to a heat transfer direction in the case where the thermoconductive member includes chopped carbonaceous fibers. Referring to FIG. 9, the ceramic fillers 2000 and the chopped fibers were hybridized to shorten the heat conduction path.

Figure 10:
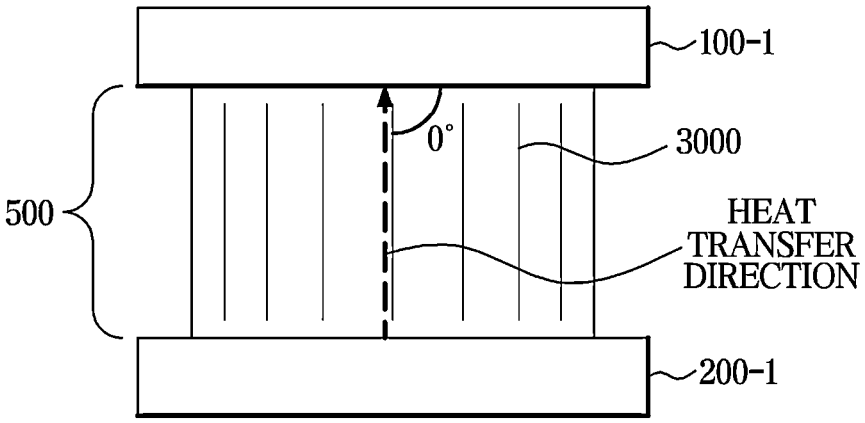
FIG. 10 is a schematic diagram of a thermoconductive member according to an embodiment of the present disclosure in which carbonaceous fibers are aligned parallel to the heat transfer direction.

FIG. 10 is a schematic diagram illustrating a thermoconductive member according to an embodiment of the present disclosure in which carbonaceous fibers are arranged parallel to the heat transfer direction. Referring to FIG. 10, in the case where the thermoconductive member according to an embodiment of the present disclosure is joined, heat is transferred to a contact surface in a direction perpendicular to the contact surface so that a temperature gradient is formed between opposite contact surfaces for heat transfer. In this regard, the direction in which the temperature gradient is formed and the arrangement of acicular fibers form 0° in an ideal case. In this case, the shortest heat conduction path is formed, thereby obtaining the highest heat transfer efficiency. In this regard, the direction in which the temperature gradient is formed may be interpreted equally as heat conduction direction or heat transfer direction, and the heat conduction direction refers to a direction of a flow from a high temperature to a low temperature in a direction perpendicular to opposite contact surfaces of junctions of the thermoconductive member. The contact surfaces of the thermoconductive member may be, for example, the first heat dissipation plate 200-1 and the endothermic surface 100-1 of the thermoelectric element 100, the second heat dissipation plate 200-2 and the exothermic surface 100-2 of the thermoelectric element 100 as shown in FIGS. 10 to 13, or any contact surfaces of various regions where the thermoconductive member is used.

Figure 11:
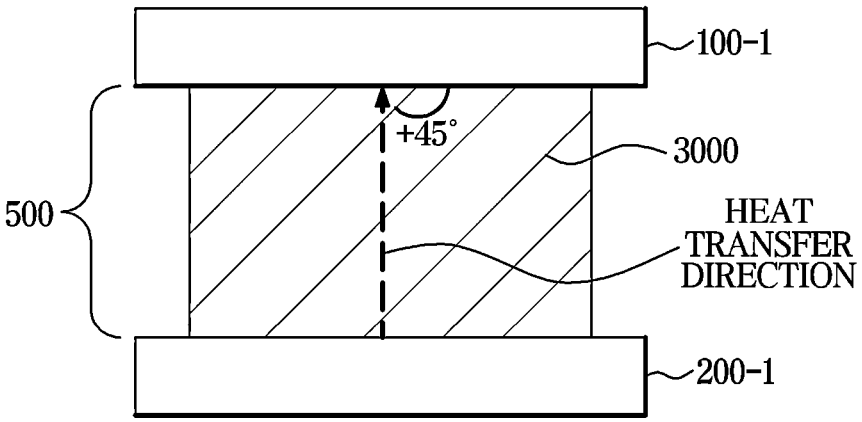
FIG. 11 is a schematic diagram of a thermoconductive member according to an embodiment of the present disclosure in which carbonaceous fibers are aligned at an angle of +45° with respect to the heat transfer direction.
Figure 12:
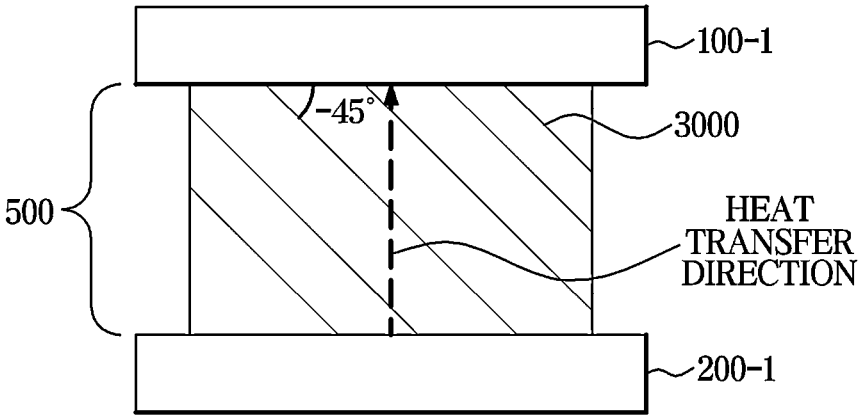
FIG. 12 is a schematic diagram of a thermoconductive member according to an embodiment of the present disclosure in which carbonaceous fibers are aligned at angles of −45° with respect to the heat transfer direction.
Figure 13:
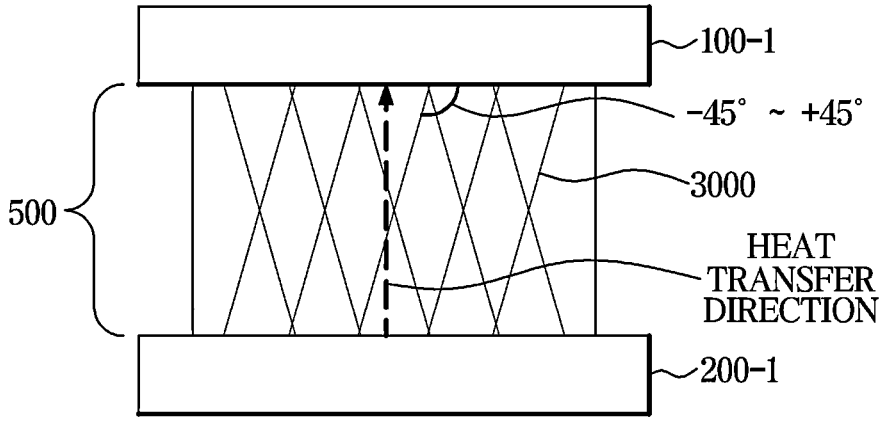
FIG. 13 is a schematic diagram of a thermoconductive member according to an embodiment of the present disclosure in which carbonaceous fibers are aligned at angles of −45° to +45° with respect to the heat transfer direction.

FIGS. 11 to 13 are schematic diagrams illustrating thermoconductive members according to embodiments of the present disclosure in which carbonaceous fibers are aligned at angles of +45° and −45° with respect to the heat transfer direction, respectively.

Referring to FIGS. 11 to 13, the direction in which the temperature gradient is formed and the arrangement of acicular carbonaceous fiber fillers 3000 may form a tilted angle of −45° to +45°, in some cases. This is a case where arrangement of the fiber particles is tilted due to a defect or error during a manufacturing process, and slightly lower heat transfer efficiency and similar heat transfer efficiency are obtained, as compared to the case of 0°.

The thermoconductive member according to an embodiment of the present disclosure may have a thickness of 50 μm to 400 μm in the direction where the temperature gradient is formed (heat transfer direction) to implement compact products.

In the thermoconductive member according to an embodiment of the present disclosure, the carbonaceous fiber 3000 may have an average length of 50 μm to 400 μm. In addition, the carbonaceous fibers may form a tilted angle of −45° to +45° as described above, so that the carbonaceous fibers may have an average length of −20% to +20% of a distance between the one side and the other side.

In addition, thermal conductivity may decrease at a low C content because distribution thereof decreases, and thus the carbonaceous fibers 3000 may have a C content of 90% or more in an elemental analysis.

In the thermoconductive member according to an embodiment of the present disclosure, the carbonaceous fibers may include at least one of carbon fibers, graphene flakes, carbon nanotubes, or graphene nanotubes.

The binder may be a silicone-based resin, and the ceramic filler may be $Al_2O_3$, ZnO, or Al, but is not limited thereto.

The thermoconductive member 500 according to the present disclosure may include, in percent by weight (wt %), 10 to 40% of the carbonaceous fibers 3000, 5 to 40% of the ceramic fillers 2000, and 20 to 85% of the binder 1000.

The thermoconductive member 500 according to the present disclosure may be applied to any junctions for heat conduction through which heat is transferred such as junctions between both surfaces 100-1 and 100-2 of the thermoelectric element 100 and the heat dissipation plates 200-1 and 200-2 or junctions between the heat dissipation plates 200-1 and 200-2 and the heat exchangers 300 and 400, respectively.

The thermoconductive member 500 according to the present disclosure may be applied to refrigerators as described above, but is not limited thereto, and may also be applied to any products that may be provided with a cooling device, e.g., washing machines, cooking apparatuses, and air conditioners.

Hereinafter, a method for manufacturing a thermoconductive member according to an embodiment of the present disclosure will be described.

To manufacture the thermoconductive member 500 of the present disclosure having a structure in which ceramic fillers 2000 having spherical particles and carbonaceous fibers 3000 having acicular particles are mixed in a binder 1000, the fibers may be arranged by drawing and extrusion.

Specifically, a single strand or multiple strands of carbonaceous fibers are extracted, and the extracted carbonaceous fibers are immersed in a liquid binder material to mix the two materials. Subsequently, a junction material is molded and pulled in accordance with a desired cross-sectional size, and the junction material pulled into a cylindrical shape may be cut and used as a thermoconductive member.

According to another manufacturing method, the fibers may be arranged by rolling.

Specifically, carbonaceous fibers are arranged in a binder material and, upon completion of the arrangement, the resultant is rolled to form a cylindrical shape. Then, the rolled cylindrical shape is cut such that the carbonaceous fibers arranged therein are perpendicular to a lengthwise direction and may be used as a thermoconductive member.

According to another manufacturing method, the fibers may be arranged by layering up.

Specifically, a single layer is manufactured by arranging carbonaceous fibers in a binder material, and upon completion of the arrangement, the single layers are layered up to form a multilayer shape. Then, the layered up shape is cut such that the carbonaceous fibers arranged therein are perpendicular to a lengthwise direction and may be used as a thermoconductive member.

According to the above-described manufacturing methods, the thermoconductive member 500 according to the present disclosure having a structure in which ceramic fillers 2000 having spherical particles and carbonaceous fibers 3000 having acicular particles are mixed in a binder 1000 may be manufactured, but the present disclosure is not limited thereto.

Figure 14:
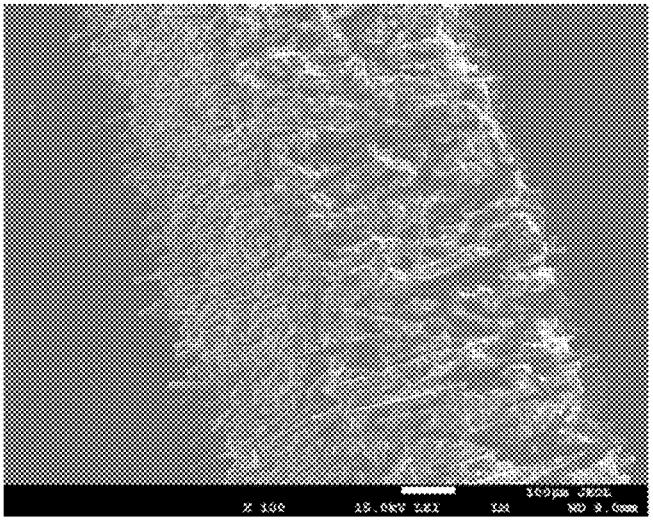
FIGS. 14 and 15 are SEM images showing shapes carbonaceous fibers included in the thermoconductive members according to an embodiment of the present disclosure.
Figure 15:
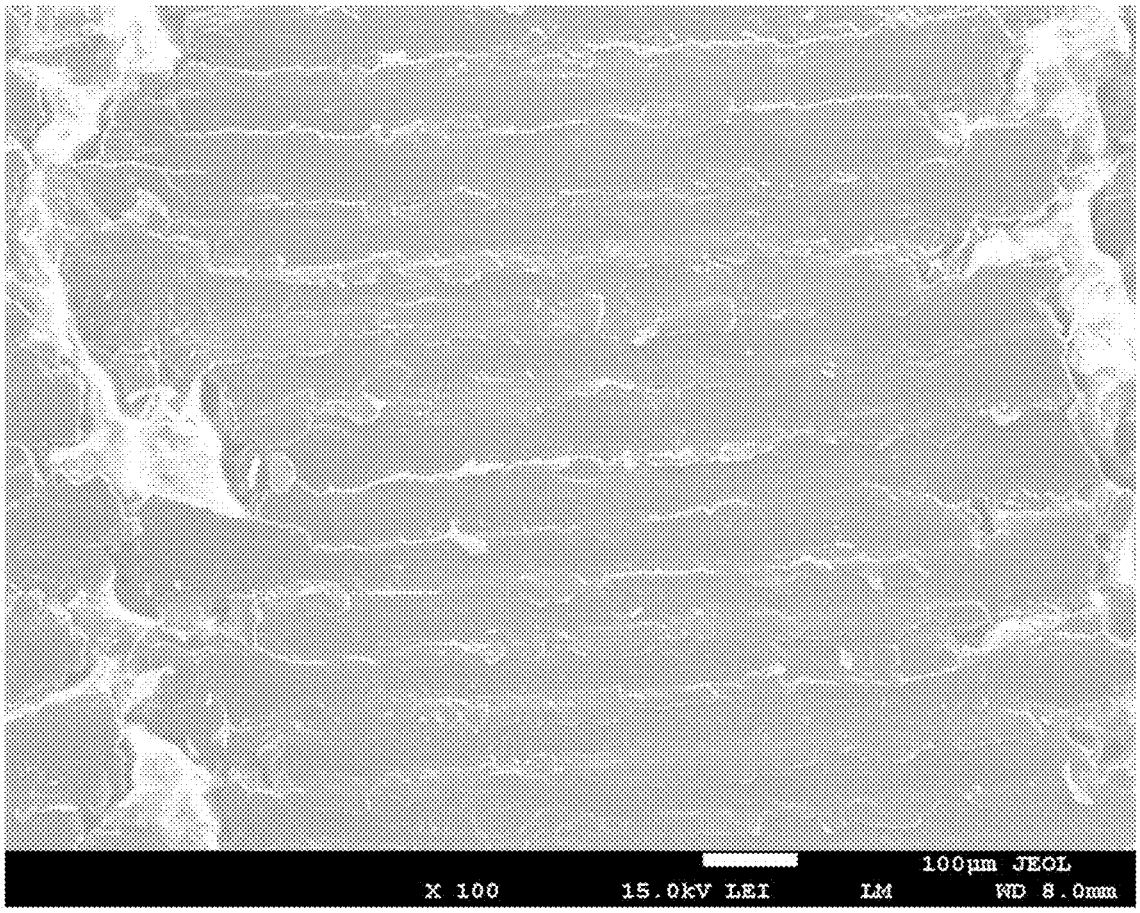
Figure 16:
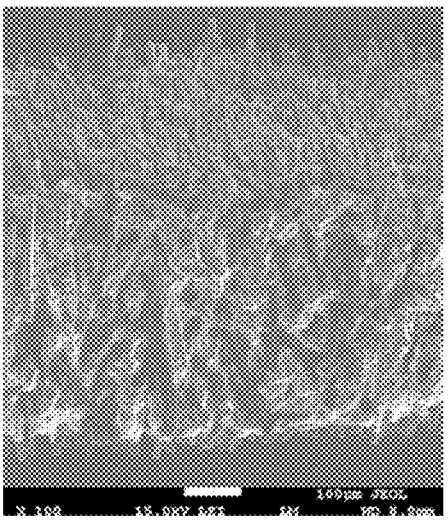
FIG. 16 is an SEM image of a surface of a thermoconductive member according to Example 2 cut in a direction parallel to the heat transfer direction.

FIGS. 14 and 15 are SEM images showing shapes of carbonaceous fibers included in the thermoconductive members manufactured according to the above-described methods. Acicular particles of the fiber material may be observed.

The refrigerator 1 according to an embodiment of the present disclosure may further include a cool air supply device configured to supply cool air to the storage compartment 3.

The cool air supply device may include a machine, apparatus, electronic device, and/or a system including any combination thereof which are configured to generate cool air and cool the storage compartment by guiding the cool air.

The cool air supply device may general cool air through a refrigeration cycle including compression, condensation, expansion, and evaporation of a refrigerant. To this end, the cool air supply device may include a refrigeration cycle device including a compressor, a condenser, an expansion device, and an evaporator capable of driving the refrigeration cycle.

The refrigerator may include a machine room in which at least some parts belonging to the cool air supply device are disposed, and the machine room may be provided to be separated and insulated from the storage compartment to prevent heat generated by the parts disposed in the machine room from being transferred to the storage compartment. In addition, the inside of the machine room may be provided to communicate with the outside of the main body such that heat is dissipated from the parts disposed in the machine room.

As described above, because the refrigerator 1 according to an embodiment of the present disclosure includes the thermoelectric element cooling device and the refrigeration cycle device for cooling the storage compartment 3, the method for supplying cool air to the storage compartment 3 may include a first method of supplying only cool air generated by the thermoelectric element cooling device 10, a second method of supplying only cool air generated by the refrigeration cycle device, and a third method of simultaneously supplying cool air generated by the thermoelectric element cooling device and cool air generated by the refrigeration cycle device.

The refrigerator 1 may supply cool air to the storage compartment 3 by an appropriate method according to external and internal conditions. For example, the refrigerator 1 may cool the storage compartment 3 by using one or the methods depending on indoor temperature of a room in which the refrigerator 1 is installed. That is, in the case where cooling by the refrigeration cycle device is more effective than cooling by the thermoelectric element cooling device at an indoor temperature higher than a predetermined temperature, the storage compartment 3 may be cooled only by the cool air generated by the refrigeration cycle device. On the contrary, in the case where cooling by the thermoelectric element cooling device is more effective than cooling by the refrigeration cycle device at an indoor temperature lower than a predetermined temperature, the storage compartment 3 may be cooled only by the cool air generated by the thermoelectric element cooling device. The refrigerator 1 may operate only the thermoelectric element cooling device in the case where noise reduction is required. The refrigerator 1 may simultaneously supply the cool air generated by the thermoelectric element cooling device and the cool air generated by the refrigeration cycle device in the case where rapid cooling of the storage compartment 3 is required.

As such, the refrigerator 1 may include the thermoelectric element cooling device and the refrigeration cycle device according to an embodiment of the present disclosure, but is not limited thereto, and may include only the thermoelectric element cooling device 10.

The refrigerator 1 according to the present disclosure may include a controller configured to control the refrigerator. The controller may include a memory to store or recall programs and/or data for controlling the refrigerator, and a processor configured to output control signals to control the cool air supply device and the like according to the programs and/or data stored in the memory.

A memory stores or records a variety of information, data, instructions, programs, and the like required for the operation of the refrigerator. The memory may store temporary data generated while creating control signals to control components included in the refrigerator. The memory may include at least one of a volatile memory or a non-volatile memory, or any combination thereof.

Hereinafter, the present disclosure will be described in more detail with reference to the following examples. However, it is necessary to note that the following examples are only intended to illustrate the present disclosure in more detail and are not intended to limit the scope of the present disclosure. This is because the scope of the present disclosure is determined by matters described in the claims and able to be reasonably inferred therefrom.

Examples

Thermoconductive members of a comparative example and examples having the compositions shown in Table 1 below were manufactured, and average angles of fibers, thermal conductivity, and heat resistance were measured as shown below. The average angles of fibers were obtained by measuring tilted angles with respect to a direction perpendicular to surfaces in contact with opposite contact surfaces, and an average of measurement values obtained at 10 random points was calculated.

| | Composition (wt %) | | | Average | Thermal | Heat |
|---|---|---|---|---|---|---|
| Category | Carbonaceous fiber | Ceramic filler | Binder | angle of fiber (°) | conductivity (W/m · K) | resistance (K/W) |
| Comparative Example | — | 22 | 78 | — | 5 | 0.2 |
| Example 1 | 15 | 7 | 78 | 0 | 38 | 0.00290 |
| Example 2 | 15 | 7 | 78 | 10 | 34 | 0.00296 |
| Example 3 | 15 | 7 | 78 | 20 | 26 | 0.00313 |
| Example 4 | 15 | 7 | 78 | 30 | 23 | 0.00329 |
| Example 5 | 15 | 7 | 78 | 40 | 18 | 0.00338 |

Referring to Table 1, it was confirmed that the thermoconductive member of the comparative example not including acicular carbonaceous fibers had a thermal conductivity of 5 W/m·K indicating inferior thermal conductivity because the heat conduction path was longer or disconnected.

On the contrary, it was confirmed that the thermoconductive members of Examples 1 to 5 including carbonaceous fibers had a thermal conductivity or 15 W/m·K or more. Particularly, the closer the average angle of fibers was to 0, the higher the thermal conductivity and the lower the heat resistance.

A thermoelectric element cooling device according to an embodiment includes: a thermoelectric element having an endothermic surface and an exothermic surface; a first heat dissipation plate connected to the endothermic surface and configured to dissipate heat to the endothermic surface; a first heat exchanger configured to transfer heat to the first heat dissipation plate; a second heat dissipation plate configured to dissipate heat received from the exothermic surface to a second heat exchanger; the second heat exchanger configured to release heat received from the second heat dissipation plate to the outside; and a thermoconductive member disposed at at least one position between the endothermic surface of the thermoelectric element and the first heat dissipation plate or between the exothermic surface and the second heat dissipation plate, wherein the thermoconductive member has: one side in contact with one of the surfaces of the thermoelectric element; and the other side in contact with the first heat dissipation plate or the second heat dissipation plate, the thermoconductive member includes a plurality of anisotropic, thermoconductive fillers, and at least one of the plurality of anisotropic, thermoconductive fillers is located adjacent to the one side and the other side.

In the thermoelectric element cooling device according to an embodiment, the plurality of anisotropic, thermoconductive fillers may include one or more carbonaceous fibers, and the carbonaceous fibers may be arranged in a lengthwise direction toward the one side and the other side.

In the thermoelectric element cooling device according to an embodiment, the carbonaceous fibers may have an average length of −20% to +20% of a distance between the one side and the other side.

In the thermoelectric element cooling device according to an embodiment, the carbonaceous fibers may be aligned at angles of −45° to +45° with respect to the lengthwise direction.

In the thermoelectric element cooling device according to an embodiment, the carbonaceous fibers may have a C content of 90% or more in an elemental analysis.

In the thermoelectric element cooling device according to an embodiment, the carbonaceous fibers may have an average thermal conductivity of 100 W/m·K or more.

In the thermoelectric element cooling device according to an embodiment, the carbonaceous fibers may include at least one of carbon fibers, graphene flakes, carbon nanotubes, and graphene nanotubes.

In the thermoelectric element cooling device according to an embodiment, the thermoconductive member may further include a ceramic filler and a binder.

In the thermoelectric element cooling device according to an embodiment, the binder may include a silicone-based resin.

In the thermoelectric element cooling device according to an embodiment, the thermoconductive member may have an average thickness of 50 μm to 200 μm.

A thermoelectric element cooling device according to another embodiment includes: a thermoelectric element having an endothermic surface and an exothermic surface; a first heat dissipation plate connected to the endothermic surface and configured to dissipate heat to the endothermic surface; a first heat exchanger configured to transfer heat to the first heat dissipation plate; a second heat dissipation plate configured to dissipate heat received from the exothermic surface to a second heat exchanger; the second heat exchanger configured to release heat received from the second heat dissipation plate to the outside; and a thermoconductive member disposed at at least one position between the endothermic surface of the thermoelectric element and the first heat dissipation plate or between the exothermic surface and the second heat dissipation plate, wherein the thermoconductive member includes carbonaceous fibers having a C content of 90% or more, and a silicone-based binder, the carbonaceous fibers are aligned at angles of −45° to +45° with respect to a heat conduction direction, and the thermoconductive member has an average thermal conductivity of 15 W/m·K or more.

In the thermoelectric element cooling device according to an embodiment, the carbonaceous fibers may have an average length of 50 μm to 400 μm.

In the thermoelectric element cooling device according to an embodiment, the carbonaceous fibers may have a C content of 90% or more in an elemental analysis.

In the thermoelectric element cooling device according to an embodiment, the carbonaceous fibers may have an average thermal conductivity of 100 W/m·K or more.

In the thermoelectric element cooling device according to an embodiment, the carbonaceous fibers may include at least one of carbon fibers, graphene flakes, carbon nanotubes, and graphene nanotubes.

In the thermoelectric element cooling device according to an embodiment, the thermoconductive member may have an average thickness of 50 μm to 200 μm.

A thermoelectric element refrigerator according to an embodiment includes: a main body; a storage compartment formed in the main body; and a thermoelectric element cooling device configured to cool the storage compartment, wherein the thermoelectric element cooling device includes: a first heat exchanger provided in the storage compartment and configured to transfer heat from the storage compartment to a first heat dissipation plate; a first heat dissipation plate connected to the first heat exchanger and configured to transfer heat to an endothermic surface; a thermoelectric element having the endothermic surface on one surface and an exothermic surface on the other surface; a second heat dissipation plate configured to dissipate heat received from the exothermic surface to a second heat exchanger; the second heat exchanger configured to dissipate heat received from the second heat dissipation plate out of the main body; and a thermoconductive member disposed at at least one position between the endothermic surface of the thermoelectric element and the first heat dissipation plate or between the exothermic surface and the second heat dissipation plate, wherein the thermoconductive member has: one side in contact with one of the surfaces of the thermoelectric element; and the other side in contact with the first heat dissipation plate or the second heat dissipation plate, the thermoconductive member includes a plurality of anisotropic, thermoconductive fillers, and at least one of the plurality of anisotropic, thermoconductive fillers is located adjacent to the one side and the other side.

In the thermoelectric element refrigerator according to an embodiment, the plurality of anisotropic, thermoconductive fillers may include one or more carbonaceous fibers, and the carbonaceous fibers may be arranged in a lengthwise direction toward the one side and the other side.

In the thermoelectric element refrigerator according to an embodiment, the carbonaceous fibers may be aligned at angles of −45° to +45° with respect to the lengthwise direction.

In the thermoelectric element refrigerator according to an embodiment, the first heat exchanger or the second heat exchanger may include heat exchange fins and a fan device.

A thermoelectric element refrigerator according to an embodiment includes: a main body; a storage compartment formed in the main body; and a thermoelectric element cooling device configured to cool the storage compartment, wherein the thermoelectric element cooling device includes: a first heat exchanger provided in the storage compartment and configured to transfer heat from the storage compartment to a first heat dissipation plate; the first heat dissipation plate connected to the first heat exchanger and configured to transfer heat to an endothermic surface; a thermoelectric element having the endothermic surface on one surface and an exothermic surface on the other surface; a second heat dissipation plate configured to dissipate heat received from the exothermic surface to a second heat exchanger; the second heat exchanger configured to dissipate heat received from the second heat dissipation plate out of the main body; and a thermoconductive member disposed at at least one position between the endothermic surface of the thermoelectric element and the first heat dissipation plate or between the exothermic surface and the second heat dissipation plate, wherein the thermoconductive member includes carbonaceous fibers having a C content of 90% or more, and a silicone-based binder, the carbonaceous fibers are aligned at angles of −45° to +45° with respect to a heat conduction direction, and the thermoconductive member has an average thermal conductivity of 15 W/m·K or more.

The thermoelectric element cooling device and the refrigerator including the same according to the present disclosure are described.

Although the embodiments of the present disclosure have been provided for illustrative purposes, the scope of the present disclosure is limited thereto. Various embodiments that may be modified and altered by those skilled in the art without departing from the principles and spirit of the present disclosure, the scope of which is defined in the claims, should be construed as falling within the scope of the present disclosure.

The invention claimed is:

1. A thermoelectric element cooling device comprising:

a thermoelectric element including an endothermic surface and an exothermic surface;

a first heat dissipation plate connected to the endothermic surface and configured to dissipate heat to the endothermic surface;

a first heat exchanger configured to transfer heat to the first heat dissipation plate;

a second heat dissipation plate configured to dissipate heat received from the exothermic surface;

a second heat exchanger configured to release heat received from the second heat dissipation plate to the outside; and a thermoconductive member disposed at at least one of:

a position between the endothermic surface of the thermoelectric element and the first heat dissipation plate or a position between the exothermic surface and the second heat dissipation plate, wherein the thermoconductive member has:

one side in contact with one of the surfaces of the thermoelectric element; and the other side in contact with the first heat dissipation plate or the second heat dissipation plate, the thermoconductive member includes a plurality of anisotropic, thermoconductive fillers, and at least one anisoptropic, thermoconductive filler of the plurality of anisotropic, thermoconductive fillers is located adjacent to each of the one side and the other side.

2. The thermoelectric element cooling device according to claim 1, wherein the plurality of anisotropic, thermoconductive fillers includes one or more carbonaceous fibers, and the one or more carbonaceous fibers are arranged in a lengthwise direction toward the one side and the other side.

3. The thermoelectric element cooling device according to claim 2, wherein the one or more carbonaceous fibers have an average length of −20% to +20% of a distance between the one side and the other side.

4. The thermoelectric element cooling device according to claim 2, wherein the one or more carbonaceous fibers are aligned at angles of −45° to +45° with respect to the lengthwise direction.

5. The thermoelectric element cooling device according to claim 2, wherein the one or more carbonaceous fibers have a C content of 90% or more in an elemental analysis.

6. The thermoelectric element cooling device according to claim 2, wherein the one or more carbonaceous fibers have an average thermal conductivity of 100 W/m·K or more.

7. The thermoelectric element cooling device according to claim 2, wherein the one or more carbonaceous fibers include at least one of carbon fibers, graphene flakes, carbon nanotubes, or graphene nanotubes.

8. The thermoelectric element cooling device according to claim 1, wherein the thermoconductive member includes a ceramic filler and a binder.

9. The thermoelectric element cooling device according to claim 8, wherein the binder includes a silicone-based resin.

10. The thermoelectric element cooling device according to claim 1, wherein the thermoconductive member has an average thickness of 50 μm to 200 μm.

11. A thermoelectric element cooling device comprising:

a thermoelectric element including an endothermic surface and an exothermic surface;

a first heat dissipation plate connected to the endothermic surface and configured to dissipate heat to the endothermic surface;

a first heat exchanger configured to transfer heat to the first heat dissipation plate;

a second heat dissipation plate configured to dissipate heat received from the exothermic surface to a second heat exchanger;

the second heat exchanger configured to release heat received from the second heat dissipation plate to the outside; and a thermoconductive member disposed at at least one of:

a position between the endothermic surface of the thermoelectric element and the first heat dissipation plate, or a position between the exothermic surface and the second heat dissipation plate, wherein the thermoconductive member includes:

a plurality of carbonaceous fibers including a C content of 90% or more, and a silicone-based binder, carbonaceous fibers of the plurality of carbonaceous fibers are aligned at angles of −45° to +45° with respect to a heat conduction direction, and the thermoconductive member has an average thermal conductivity of 15 W/m·K or more.

12. The thermoelectric element cooling device according to claim 11, wherein the carbonaceous fibers of the plurality of carbonaceous fibers have an average length of 50 μm to 400 μm.

13. The thermoelectric element cooling device according to claim 11, wherein the carbonaceous fibers of the plurality of carbonaceous fibers have a C content of 90% or more in an elemental analysis.

14. The thermoelectric element cooling device according to claim 11, wherein the carbonaceous fibers of the plurality of carbonaceous fibers have an average thermal conductivity of 100 W/m·K or more.

15. The thermoelectric element cooling device according to claim 11, wherein the carbonaceous fibers of the plurality of carbonaceous fibers include at least one of carbon fibers, graphene flakes, carbon nanotubes, or graphene nanotubes.

* * * * *